US006741035B2

(12) United States Patent
Matsushima et al.

(10) Patent No.: US 6,741,035 B2
(45) Date of Patent: May 25, 2004

(54) SHORT ARC DISCHARGE LAMP

(75) Inventors: Takeo Matsushima, Himeji (JP); Yoichiro Higashimoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/364,509

(22) Filed: Feb. 12, 2003

(65) Prior Publication Data

US 2003/0151364 A1 Aug. 14, 2003

(30) Foreign Application Priority Data

Feb. 13, 2002 (JP) ..... 2002-035038

(51) Int. Cl.[7] ..... H01J 17/18

(52) U.S. Cl. ..... 313/623; 313/624; 313/625; 313/626

(58) Field of Search ..... 313/623, 624, 313/625, 626

(56) References Cited

U.S. PATENT DOCUMENTS 4,038,578 A 7/1977 Mathijssen
6,356,018 B1 3/2002 Higashimoto et al.

*Primary Examiner*—Vip Patel
(74) *Attorney, Agent, or Firm*—Nixon Peabody LLP; David S. Safran

(57) ABSTRACT

A short arc discharge lamp in which the arc tube contains opposed cathode and anode electrodes with upholding parts that are inserted into a respective glass tube holding cylinder, and in which the glass tubes of the holding cylinders are secured in the side tubes at opposite sides of the arc tube by contracted areas, provides the peripheral surface of the holding cylinders with at least one section of reduced diameter to prevent the holding cylinders from moving, to prevent force from acting in a concentrated manner on the sealed areas and to prevent the lamp from being damaged when the lamp is shaken during transport or the like.

8 Claims, 2 Drawing Sheets

SHORT ARC DISCHARGE LAMP

BACKGROUND OF THE INVENTION

1. Field of the Invention

The invention relates to a short arc discharge lamp which is used as a light source for a projector, for semiconductor exposure, for UV curing and the like.

2. Description of the Prior Art

Conventionally, a xenon gas-filled short arc lamp is used, for example, for a light source for a projector. Recently, there has been more and more often a high demand for more radiance of the projected image of the projector. Therefore, there is the tendency to increase the amount of added xenon gas. As a result, the gas pressure in the arc tube of short arc lamps during operation, recently, has been extremely high.

In one such short arc lamp, a spherical or oval arc tube composed of silica glass is filled with xenon gas along with opposed cathode and anode electrodes. The upholding parts of the cathode and anode electrodes are sealed in ends of side tubes which adjoin opposite sides of the arc tube. To secure the upholding parts of the electrodes of the cathode and the anode, the ends of the side tubes are contracted by heating, the diameter is reduced, and thus, contracted areas are formed. However, in order to directly secure the upholding parts of the cathode and anode electrodes in the contracted areas of the side tubes, the amount of contraction must be increased.

Therefore, the upholding parts of the cathode and anode electrodes are inserted into a silica glass holding cylinder, the contracted areas of the side tubes are welded to the holding cylinders, and thus, the upholding parts of the cathode and anode electrodes are secured.

If the contracted areas of the side tubes are welded to the holding cylinders, on the weld end, a wedge-like area is formed as a small gap which leads to the formation of fractures during operation. Therefore, as can be seen from Japanese patent disclosure document HEI 11-135067 and corresponding U.S. Pat. No. 6,356,018, an arrangement is suggested in which in the outside periphery of the respective holding cylinder, there is an intermediate layer in the form of a metal layer or ceramic layer.

FIG. 1 shows as the prior art a short arc discharge lamp in a schematic cross section in which the technology described in the above described publication is used. Here, there are an anode 22 and a cathode 21 in the oval arc tube 10. Bordering the arc tube 10, there are side tubes 11 into which the upholding parts 23 of the electrodes are inserted; on their respective tip, an electrode is mounted and they are sealed on the ends of the side tubes. Thus, on the respective end of the side tube, a sealed area 13 is formed. The upholding parts 23 of the electrodes are each inserted into a holding cylinder 30 of silica glass for securing the upholding parts of the electrode and secured. The outside periphery of the respective holding cylinder 30 is provided with an intermediate layer 40 in the form of a metal layer or a ceramic layer.

However, since the contracted area 12 of the side tube and the holding cylinder 30 are not welded to one another, there is the danger that the holding cylinders 30 will move if, during transport or the like, the lamp is subjected to vibration. If the holding cylinders 30 move, the force is concentrated on the sealed areas 13; this leads to lamp damage.

SUMMARY OF THE INVENTION

The primary object of the invention is to devise a short arc lamp in which the glass tubes of the holding cylinders are prevented from moving, the force acting on the lamp is prevented from being concentrated on the sealed areas and the lamp is prevented from being damaged when the lamp is shaken during transport or the like.

In a first aspect of the invention, in a short arc discharge lamp in which in the arc tube there are opposed cathode and anode electrodes, in which the upholding parts of the cathode and anode electrodes are each secured by insertion into a holding cylinder, in which these holding cylinders are supported by contracted areas of the side tubes which adjoin the arc tube, and in which the outer periphery of the respective holding cylinder is coated with a coating material of metal or ceramic, the object is achieved by the respective holding cylinder having a part with a reduced diameter in the lengthwise direction.

The object is achieved according to one development of the invention by the holding cylinders having an outside diameter which decreases in the direction toward the cylinder middle and the holding cylinders are preferably shaped essentially like a tambourine.

The holding cylinders can, moreover, have several sections of reduced diameter in the lengthwise direction so that the holding cylinders, for example, have an outside contour with a wave shape in the lengthwise direction.

According to another aspect of the invention, in a short arc discharge lamp in which in the arc tube contains opposed cathode and anode electrodes, in which the upholding parts of the electrodes of the cathode and anode electrodes are each secured by insertion into a holding cylinder, in which these holding cylinders are supported by contracted areas of the side tubes which adjoin the arc tube, and in which the outer periphery of the respective holding cylinder is coated with a coating material of metal or ceramic, the object is achieved by the outside peripheral surface of the respective holding cylinder being provided with projections. For example, the holding cylinders can have flange-like projections on their respective ends.

The holding cylinders can have both a round-cylindrical and also a polygon-cylindrical basic shape.

The invention is described specifically below using several embodiments shown in the drawings.

DETAILED DESCRIPTION OF THE INVENTION

Figure 1:
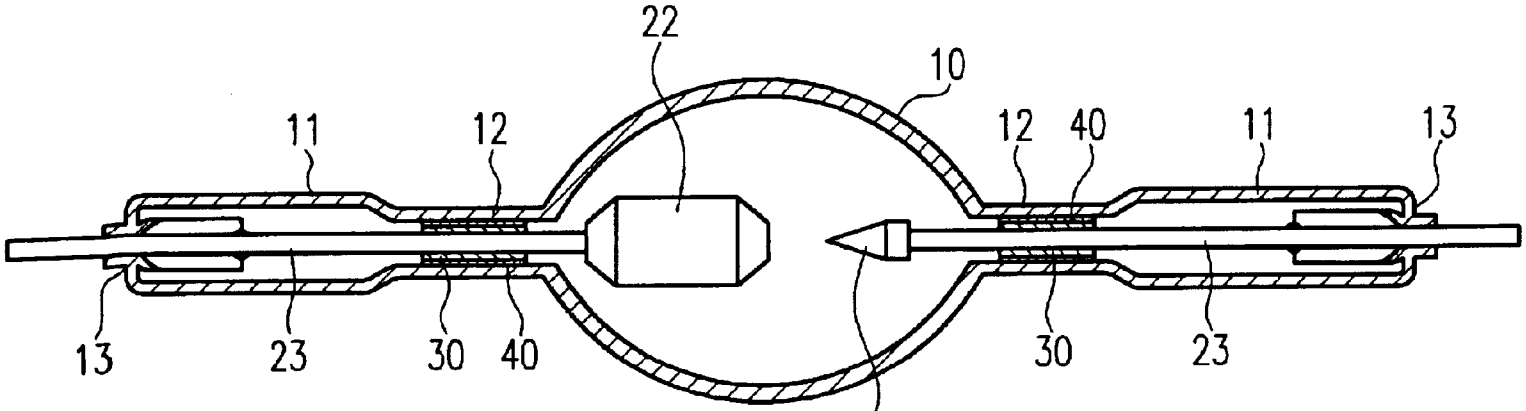
Fig. 1 (prior art)
FIG. 1 is a schematic cross-sectional view of a conventional short arc discharge lamp.
Figure 2:
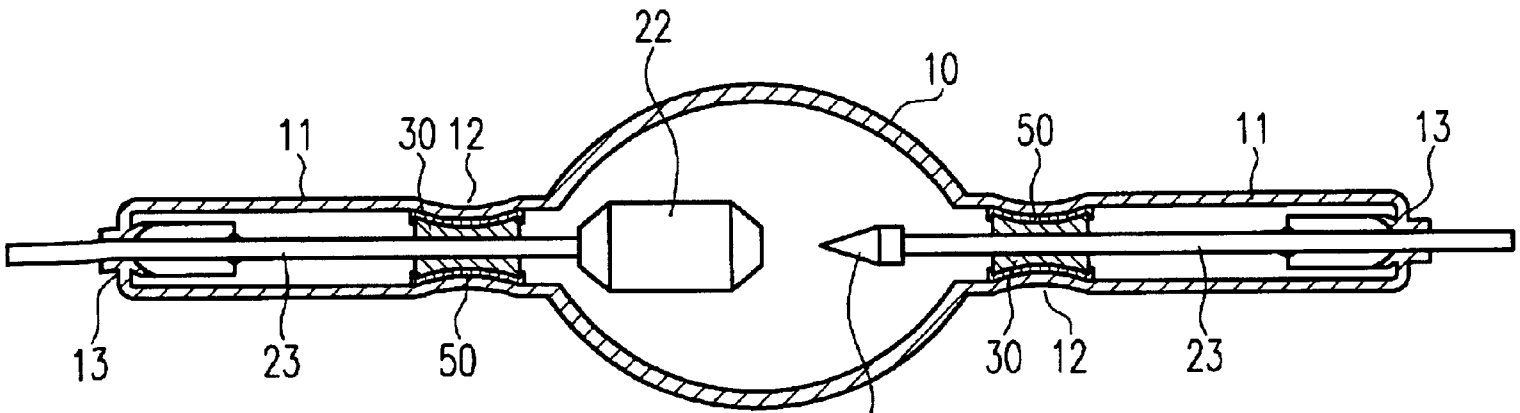
FIG. 2 is a schematic cross-sectional view of a short arc discharge lamp in accordance with the invention.

FIG. 2 shows a xenon short arc lamp as one example of a short discharge lamp in accordance with the invention. In a silica glass arc tube 10, a cathode 21 and an anode 22 are disposed opposite each other on a respective one of a pair of upholding parts 23 of the electrodes, which parts a made of tungsten rods. The arc tube 10 is filled with xenon gas. A side tube 11 extends from each of opposite sides of the arc tube 10. The upholding parts 23 of the electrodes are sealed in the sealed areas 13 on the ends of the side tubes 11.

A holding cylinder 30 of silica glass has a part on its outside peripheral surface that has a smaller diameter in its middle area in the lengthwise direction (the lengthwise direction of the upholding parts 23 of the electrodes onto which the holding cylinder is pushed). The upholding parts 23 of the electrodes are secured by the holding cylinders 30. The diameter of the side tubes 11 is reduced by exposing the inside of the arc tube 10 to a negative pressure and by heating the ends of the side tubes 11 on the side of the arc tube 10. In this way, contracted areas 12 are formed. Between the respective holding cylinder 30 and the respective contracted area 12, as is shown in FIG. 2, a coating material 50 of metal or ceramic is applied. The respective holding cylinder 30 and the respective contracted area 12 are attached to one another by this coating without their being connected to one another in one piece by welding.

Figure 3A:
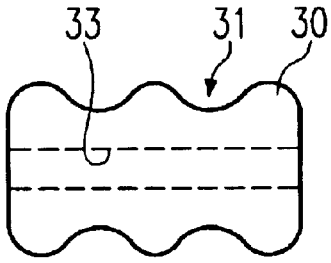
FIGS. 3(*a*) to 3(*c*) each show a schematic of a respective embodiment of a holding cylinder which is located in the short arc discharge lamp in accordance with the invention.
Figure 3B:
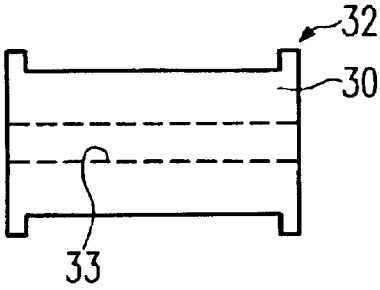
Figure 3C:
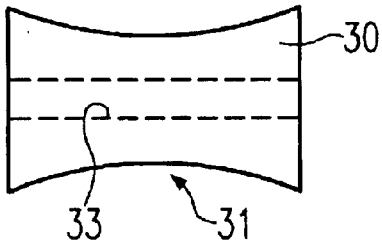

The holding cylinder 30 can have the shapes shown, by way of example, in FIGS. 3(*a*), 3(*b*) and 3(*c*). The holding cylinder 30, in its lengthwise direction, has a part 31 with a reduced diameter (two parts in the FIG. 3(*a*) embodiment). By heating the outside periphery of the side tube, the side tube is heated especially at the point which corresponds to the part(s) 31 with a smaller diameter, by which the contracted area(s) 12 is/are formed. Thus, attachment takes place such that the holding cylinder 30 is squeezed. In FIG. 3(*b*), the area of smaller diameter is the result of the two ends of the holding cylinder 30 in the lengthwise direction being provided with annular flange-shaped projections 32. The projections 32 need not always be provided on the two ends, but it is likewise possible if they are located somewhere else on the outside peripheral surface of the holding cylinder. In FIG. 3(*c*), the holding cylinder has a somewhat tambourine-like appearance in cross section, the outer surface being longitudinally concave. This is especially advantageous with respect to ease of forming (ease of manufacture) of the glass. The holding cylinder 30 has a through opening into which the upholding part of the respective electrode is inserted.

Figure 4A:
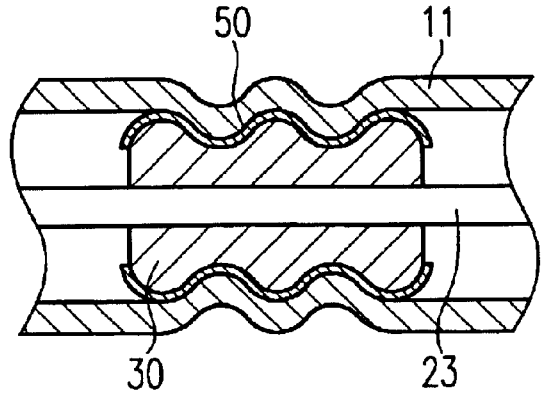
FIGS. 4(*a*) to 4(*c*) each show an enlargement of the vicinity of the holding cylinder of the short arc discharge lamp in accordance with the invention.
Figure 4B:
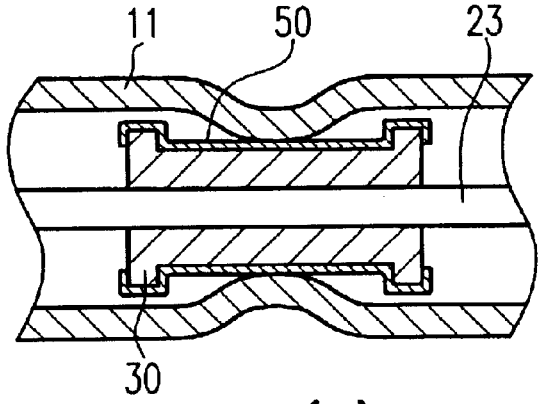
Figure 4C:
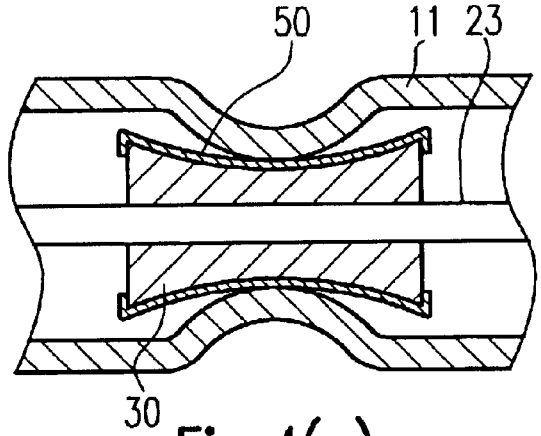

FIGS. 4(*a*), 4(*b*) and 4(*c*) each show a state in which the respective holding cylinder shown in FIGS. 3(*a*) to 3(*c*) is inserted into the side tube and the latter has been contracted by external heating of the side tube in order to attach the holding cylinder.

The coating material 50 can be, for example, a molybdenum foil. The production process is described below in this case.

First, a molybdenum foil is wound around the peripheral surface of the holding cylinder 30. When the inside of the arc tube is subjected to a negative pressure and the side tubes 11 are heated along the tube axis, their diameter is reduced and contracted areas 12 form. However, since there is a coating material 50 of molybdenum foil, the holding cylinder 30 and the contracted area 12 are attached to one another without having to be connected integrally to one another by welding. In this way, since only the process of winding the molybdenum foil, as the coating material 50, around the peripheral surface of the holding cylinder 30 is additionally required, there is the advantage that handling and production are extremely simple. The holding cylinder 30 need not always be a circular cylinder, but can also be a polygonal cylinder, for example, having a base in the shape of a pentagon. The concept of cylinder used here will designate all cylindrical forms.

Furthermore, the coating material 50 can also be a vapor-deposited metal layer or a sintered ceramic. Moreover, a metal, such as molybdenum, can be vapor deposited on the outside peripheral surface of the holding cylinder 30, for example, by sputtering.

In the case of using ceramic as the coating material 50, it is possible to proceed as follows.

Powdered ceramic, such as aluminum oxide, zirconium dioxide, silicon carbide, tantalum carbide, titanium oxide or the like is dispersed in a binder by which an application liquid is obtained which is applied to the outside peripheral surface of the holding cylinder 30 in a given thickness, heated and sintered. In this way, a ceramic coating is formed.

Action of the Invention

As was described above, in accordance with the invention, a short arc discharge lamp is obtained in which the glass tubes of the holding cylinders are prevented from moving, force is prevented from acting in a concentrated manner on the sealed areas and the lamp is prevented from being damaged when the lamp is shaken during transport or the like.

What we claim is:

1. Short arc discharge lamp comprising an arc tube within which cathode and anode electrodes are disposed in an opposed relationship to each other, each of the electrodes have an upholding part inserted into a holding cylinder; wherein side tubes are connected to opposite sides of the arc tube and the holding cylinders are secured in the side tubes by contracted areas of the side tubes, wherein a coating material of a metal or ceramic material is provided on a peripheral surface of each holding cylinder; and where each of the holding cylinders has at least one section with a reduced outside diameter between longitudinal ends thereof.

2. Short arc discharge lamp as claimed in claim 1, wherein the holding cylinders have an outside diameter which decreases in a direction toward a longitudinal middle thereof.

3. Short arc discharge lamp as claimed in claim 2, wherein the peripheral surface of the holding cylinders has a longitudinal concave curvature.

4. Short arc discharge lamp as claimed in claim 1, wherein the holding cylinders have a plurality of sections with a reduced outside diameter between longitudinal ends thereof.

5. Short arc discharge lamp as claimed in claim 4, wherein the holding cylinders have an outside contour with a wave shape in the lengthwise direction.

6. Short arc discharge lamp as claimed in claim 1, wherein the outside peripheral surface of the respective holding cylinder is provided with projections.

7. Short arc discharge lamp as claimed in claim 6, wherein said projections are flange-shaped projections on each of opposite ends thereof.

8. Short arc discharge lamp as claimed in claim 1, wherein the holding cylinders have a base of a polygonal shape.

* * * * *